United States Patent [19]

Lipp

[11] 4,133,126

[45] Jan. 9, 1979

[54] AMMUNITION LOADING AND EJECTION ARRANGEMENT

[75] Inventor: Herbert Lipp, Dusseldorf, Fed. Rep. of Germany

[73] Assignee: Rheinmetall GmbH, Dusseldorf, Fed. Rep. of Germany

[21] Appl. No.: 821,598

[22] Filed: Aug. 4, 1977

[30] Foreign Application Priority Data

Feb. 4, 1977 [DE] Fed. Rep. of Germany ..... 2704602

[51] Int. Cl.[2] ..... F41C 11/04

[52] U.S. Cl. ..... 42/23; 89/22

[58] Field of Search ..... 42/23, 24; 89/22, 24

[56] References Cited

FOREIGN PATENT DOCUMENTS 979 of 1880 United Kingdom ..... 42/23

*Primary Examiner*—Charles T. Jordan

[57] ABSTRACT

A device is disclosed for guiding rifle cartridge cases during the loading and ejecting processes, thereby facilitating the two processes.

3 Claims, 2 Drawing Figures

1
2
3
3a
4
4a
5
6
7
8
9
10
11
12
13
14

AMMUNITION LOADING AND EJECTION ARRANGEMENT

BACKGROUND OF THE INVENTION

In weapons which load, then extract a cartridge or shell past projecting edges between a sliding breech block and a breech plate, there is potential for difficulty caused by misalignment of the pieces. For long cartridges, misalignment is not a problem since the guiding of a long cartridge case starts in the chamber during loading or in other words remains during ejection when the base of the cartridge has passed the edge between the breech block and plate, a feature which is not available when the cartridge is sufficiently short and the cartridge is out of the barrel before its base has passed that edge.

In general, the sliding breech block will not be aligned with the breech plate to form a smooth bore half cylinder, and the breech block will take a different position with respect to the breech plate during loading and ejection since the breech block rebounds against the adjacent edge of the breech plate during ejection, while in loading the same edge of the breech plate overlaps the same edge of the elevated breech block. This means that each short cartridge must be loaded into the chamber by hand and that during ejection the cartridge strikes the projecting edge and either flies out of the chamber in an uncontrolled manner or is stuck.

In the prior art, there is a loading aid that does not assist in the ejection cycle (DT-PS No. 1,068,589) in the form of a projecting member attached to the breech plate with an opening coaxial with the barrel. The effect of this member and of a hold-down clamp is that it is more difficult for the point of a relatively long cartridge to strike the rear edge of the loading chamber and that the entry speed of the cartridge is reduced. Also, because of the guiding, the force with which the cartridge is pushed into the barrel is reduced.

SUMMARY OF THE INVENTION

The invention relates to a device for facilitating loading and ejection of short cartridges using a deflecting blade fastened to the sliding breech block and extending over to the breech plate, which deflecting blade is slit to form several featherlike blades. A feature of the invention is that a guide plate is attached to the end of the breech block facing the barrel, which plate extends across the loading hollow and is spaced uniformly from the breech block so that it may be adjusted and fastened in a desired position for guiding cartridges.

The guide plate is positioned by several spring loaded pins mounted in radial holes in the breech block, mating with corresponding position holes in the guide plate.

The plate is released by depressing the pins down through small holes located coaxially with the positioning holes, and passing through the guide plate to permit access with a tool.

Other advantages of the invention will become apparent from the following detailed description and drawing, in which FIG. 1 shows a view along line 1—1 of FIG. 2 of a portion of a weapon containing the device;

FIG. 2 shows a section along line 2—2 of FIG. 1.

DETAILED DESCRIPTION

Figures 1, 2:
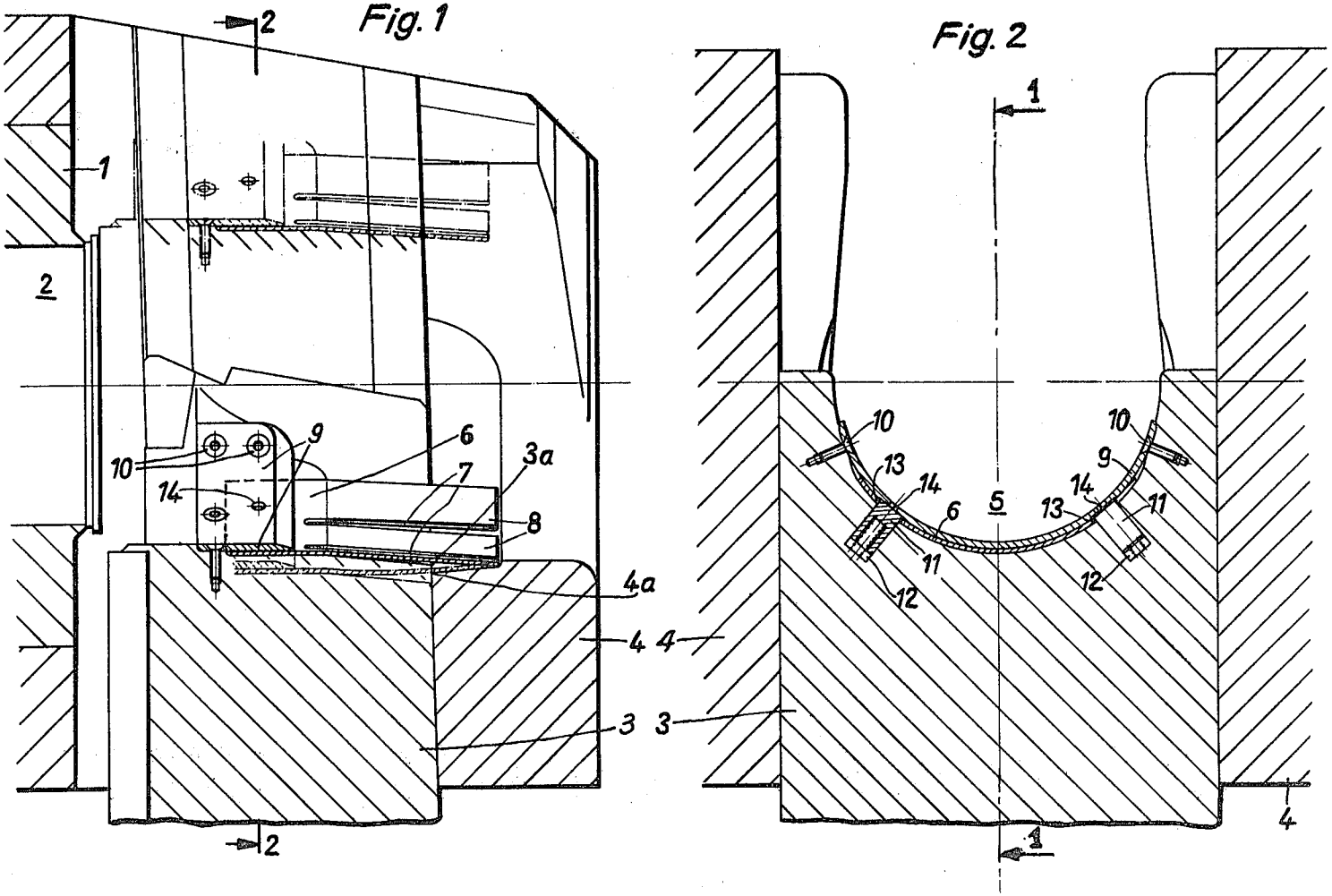

In a weapon, the rear of barrel 1 lies next to chamber 2 for loading and ejecting cartridges. Sliding breech block 3 lies between barrel 1 and breech plate 4. Edge 3*a* of breech block 3 and edge 4*a* of breech plate 4 are the edges to be bridged by the device. Edge 3*a* is shown in solid lines in FIG. 1 in the loading position and in broken lines in the position assumed during ejection, indicating the misalignment suffered with respect to edge 4*a*. This misalignment is covered by deflecting blade 6, which extends from the front of hollow 5 across breech block 3 and over onto breech plate 4. Deflecting blade 6, illustratively made from spring steel is divided by slits 7 into several flexible tongues or blades 8. The upper position of the deflecting blade 6 (illustrated in broken lines) represents the position in which the rear of the chamber 2 is fully closed. In the latter position the breech block 3 tightly seals the loading chamber 2.

Guide plate 9, at the forward end of the device is spaced uniformly a predetermined distance from breech block 3, so that a pocket is created, into which deflecting blade 6 can be pushed. Guide plate 9 is fastened at both ends to breech block 3, as can be seen in FIG. 1 and is tapered to join smoothly with it.

When deflecting blade 6 is located in its working position, locating pins 11, as shown in FIG. 2, which are fixed in radial holes 12 mate with positioning holes 13 in deflecting blade 6, thereby holding it in a predetermined position. Illustratively, positioning holes 13 extend only partially through blade 6. To release blade 6, index pins 11 are depressed by means of a tool applied through holes 14, located above them, thereby disengaging pins 11 from holes 13 and permitting the easy release of blade 6.

Flexible tongues 8 have sufficient flexibility that they may take the loading position, shown in solid lines in FIG. 1 or the ejection position, shown in broken lines while still presenting a smooth guiding surface to permit the easy loading and unloading of cartridges.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. A device for facilitating the insertion and ejection of short cartridges in a weapon having a loading channel for guiding cartridges being inserted to and ejected from a barrel, said loading channel having a half-cylindrical surface crossing over abutting misaligned edges between a sliding breech block and a breech plate, comprising:

a flexible deflecting blade having a barrel end and a breech plate end extending over said misaligned edges, which breech plate end of said deflecting blade is divided by at least one lengthwise slit into at least two flexible members, whereby said flexible deflecting blade forms a smooth surface extending over said misaligned edges.

2. A device according to claim 1 in which said barrel end rests on a guide plate for guiding cartridges into said barrel, said guide plate being spaced uniformly from said breech block, so that said flexible members may be pressed from an equilibrium position toward said breech block.

3. A device according to claim 2, in which said guide plate is fastened to said breech block by a plurality of spring-loaded positioning pins, located in said breech block and mating with a plurality of positioning holes in said guide plate, which positioning pins may be depressed into said breech block by a tool extending through a plurality of holes connecting with said positioning holes and extending through said guide plate.

* * * * *